US010009692B2

(12) United States Patent
Tomar

(10) Patent No.: US 10,009,692 B2
(45) Date of Patent: Jun. 26, 2018

(54) SPEAKER DEVICE

(71) Applicant: Jaguar Land Rover Limited, Whitley Conventry Warwickshire (GB)

(72) Inventor: Ashutosh Tomar, Coventry (GB)

(73) Assignee: Jaguar Land Rover Limited, Whitley, Coventry, Warwickshire (GB)

( * ) Notice: Subject to any disclaimer, the term of this patent is extended or adjusted under 35 U.S.C. 154(b) by 1 day.

(21) Appl. No.: 14/898,319

(22) PCT Filed: Jun. 16, 2014

(86) PCT No.: PCT/EP2014/062517
§ 371 (c)(1),
(2) Date: Dec. 14, 2015

(87) PCT Pub. No.: WO2014/198958
PCT Pub. Date: Dec. 18, 2014

(65) Prior Publication Data

US 2016/0205479 A1 Jul. 14, 2016

(30) Foreign Application Priority Data

Jun. 14, 2013 (GB) ..... 1310627.3

(51) Int. Cl.
*H04R 1/00* (2006.01)
*H04R 9/06* (2006.01)
(Continued)

(52) U.S. Cl.
CPC ..... *H04R 9/025* (2013.01); *H04R 1/2896* (2013.01); *H04R 1/323* (2013.01); *H04R 7/26* (2013.01);
(Continued)

(58) Field of Classification Search
CPC ..... H04R 9/025; H04R 1/2896; H04R 1/323; H04R 9/04; H04R 9/063; H04R 2499/13
(Continued)

(56) References Cited

U.S. PATENT DOCUMENTS 4,472,605 A * 9/1984 Klein ..... H04R 1/403 181/144
4,507,759 A 3/1985 Yasui et al.
(Continued)

FOREIGN PATENT DOCUMENTS

EP 0299116 A1 1/1989
EP 2139266 A1 12/2009
(Continued)

OTHER PUBLICATIONS

Combined Search and Examination Report corresponding to Application No. GB1310627.3, dated Nov. 27, 2013, 6 pages.
(Continued)

*Primary Examiner* — Sean H Nguyen
(74) *Attorney, Agent, or Firm* — Reising Ethington P.C.

(57) ABSTRACT

The present invention relates to a speaker device (1) having a first diaphragm (3) and a second diaphragm (5). A first magnet (19) is mounted to the first diaphragm (3) and a second magnet (25) is mounted to the second diaphragm (5). The first magnet (19) is a first electromagnet having a first coil (23) and a power source driver is provided for supplying an electrical drive signal to the first coil (23) to establish said first magnetic field. The first and second magnets (19, 25) are arranged to generate first and second interacting magnetic fields which drive the first and second diaphragms (3, 5). The invention also relates to a speaker device (101) in which the second diaphragm (5) is replaced with a fixed back plate (135). The present invention also relates to a speaker assembly (45) made up of an array of the speaker
(Continued)

devices (1; 101). The speaker device (1) can be used in a motor vehicle.

20 Claims, 4 Drawing Sheets

(51) Int. Cl.

| | |
|---|---|
| ***H04R 11/02*** | (2006.01) |
| ***H04R 9/02*** | (2006.01) |
| ***H04R 1/28*** | (2006.01) |
| ***H04R 1/32*** | (2006.01) |
| ***H04R 7/26*** | (2006.01) |
| ***H04R 9/04*** | (2006.01) |

(52) U.S. Cl.
CPC ..... *H04R 9/04* (2013.01); *H04R 9/063* (2013.01); *H04R 2499/13* (2013.01)

(58) Field of Classification Search
USPC ..... 381/398
See application file for complete search history.

(56) References Cited

U.S. PATENT DOCUMENTS

| | | | | |
|---|---|---|---|---|
| 5,847,922 | A | 12/1998 | Smith et al. | |
| 6,009,047 | A | 12/1999 | Barger | |
| 6,896,096 | B2 | 5/2005 | Nevill et al. | |
| 2004/0028240 | A1* | 2/2004 | Spinale | H04R 1/323 381/87 |
| 2010/0080406 | A1 | 4/2010 | Yang | |
| 2010/0124337 | A1* | 5/2010 | Wertz | G10K 11/1782 381/71.11 |
| 2011/0002494 | A1 | 1/2011 | Opitz | |
| 2013/0062710 | A1* | 3/2013 | Dehe | G01L 9/0016 257/415 |

FOREIGN PATENT DOCUMENTS

| | | | |
|---|---|---|---|
| GB | 2365250 | A | 2/2002 |
| JP | 2005286528 | A | 10/2005 |
| KR | 20070071230 | A | 7/2007 |
| WO | 2012085350 | A1 | 6/2012 |

OTHER PUBLICATIONS

Combined Search and Examination Report corresponding to Application No. GB1410665.2, dated Nov. 12, 2014, 6 pages.
Written Opinion corresponding with International Application No. PCT/EP2014/062517, 9 pages.
International Search Report corresponding to Application No. PCT/EP2014/062517, 5 pages.

* cited by examiner

SPEAKER DEVICE

TECHNICAL FIELD

The present invention relates to a speaker device, to a speaker assembly, to a silencer, and to a motor vehicle including a speaker device.

BACKGROUND OF THE INVENTION

A conventional loud speaker typically comprises a fixed permanent magnet which interacts with an electromagnet (voice coil) mounted to a diaphragm. By controlling the current supplied to the electromagnet, the diaphragm is driven and the resulting vibrations output acoustic waves. In order to reduce the size and packaging requirements, stronger magnets are required in the loud speakers and these may comprise rare-earth elements, for example neodymium magnets and samarium-cobalt magnets. The use of these types of magnets increases the cost of the speaker devices.

It is known from US 2010/0080406 to provide a push-pull type speaker device comprising first and second diaphragms. A pair of electromagnets, corresponding to the first and second diaphragms, is provided for cooperating with a permanent magnet disposed between the diaphragms. A power source power driver is provided for supplying current to the pair of electromagnets. The winding direction of the electromagnets is reversed such that the pair of electromagnets have opposite magnetic flux directions.

U.S. Pat. No. 2,274,513 discloses an electromagnetic speaker having a diaphragm comprising a magnetic plate moveable between opposing groupings of electromagnets.

U.S. Pat. No. 5,901,235 discloses a planar magnetic transducer comprising a diaphragm having electrical conductors. The diaphragm is mounted between arrays of permanent magnets.

At least in certain embodiments, the present invention sets out to overcome shortcomings associated with the prior art arrangements.

SUMMARY OF THE INVENTION

Aspects of the present invention relate to a speaker device; a speaker assembly; and a motor vehicle including a speaker device.

According to an aspect of the present invention there is provided a speaker device comprising:

- a first diaphragm and a second diaphragm;
- a first magnet, mounted to the first diaphragm, for generating a first magnetic field; and
- a second magnet, mounted to the second diaphragm, for generating a second magnetic field;
- wherein the first magnet is a first electromagnet comprising a first coil for receiving a first electrical drive signal to establish said first magnetic field;
- the first and second magnets being positioned such that, in use, said first and second magnetic fields interact with each other to drive said first and second diaphragms. In use, the first magnetic field interacts with the second magnetic field to apply a driving force. The mutual interaction between said first and second magnets drives the respective first and second diaphragms. By controlling the first electrical drive signal, vibrations can be induced in the first and second diaphragms resulting in the output of acoustic waves. In use, the first and second diaphragms are driven in opposite directions, either towards each other or away from each other.

The first diaphragm can comprise a first cone; and/or the second diaphragm can comprise a second cone. The first and second cones can have different configurations, for example different radius and/or taper angles. Alternatively, the first and second cones can have at least substantially the same configuration. The first and second cones can be arranged co-axially. The first and second cones can face in opposite directions, for example to taper outwardly away from each other. The first and second diaphragms can be formed from a resilient material, for example a plastics material, a composite structure, a paper composition and so on. The resilient material can return the diaphragms to respective neutral positions.

The second magnet can be a permanent magnet. Alternatively, the second magnet can be a second electromagnet including a second coil for receiving a second electrical drive signal to establish said second magnetic field. In use, the first magnetic field interacts with the second coil to apply a driving force; and the second magnetic field interacts with the first coil to apply a driving force. The mutual interaction between said first and second coils drives the respective first and second diaphragms. By controlling the first and second electrical drive signals, vibrations can be induced in the first and second diaphragms.

In a further alternative, the second magnet can comprise a second coil which is a closed (short) circuit. The first and second diaphragms can be driven by mutual electromagnetic induction between the first and second coils when a first electrical drive signal is supplied to the first coil.

The speaker device can comprise a power source driver for supplying said first electrical drive signal and/or said second electrical drive signal. The power source driver can be configured to control the first electrical drive signal to vary the magnitude and/or direction of the first magnetic field. Similarly, the power source driver can be configured to control the second electrical drive signal to vary the magnitude and/or direction of the second magnetic field. The first and second electrical drive signals could be supplied by respective first and second power source drivers. The first and second electrical drive signals can be generated in response to a sound signal. The relative position of the first and second diaphragms is dependent on the differential between the first and second electrical drive signals. It will be understood, therefore, that the speaker device forms a differential transducer.

The power source driver can be configured operatively to control said first electrical drive signal and/or said second electrical drive signal to drive said first and second diaphragms in opposite directions. The first electrical drive signal and/or the second electrical drive signal can simultaneously drive said first and second diaphragms towards each other or away from each other. The first and second coils can be configured to generate opposing forces (i.e. to establish like magnetic poles disposed adjacent to each other); or to generate attractive forces (i.e. to establish opposite magnetic poles disposed adjacent to each other).

The first and second electrical drive signals can be in phase or out of phase (typically by 180°) depending on the relative winding directions of the first and second coils. The winding direction of the first coil can be the same as the winding direction of the second coil when the power source driver is configured to supply first and second electrical drive signals which are out of phase with each other. Alternatively, the winding direction of the first coil can be the opposite of the winding direction of the second coil when the power source driver is configured to supply first and second electrical drive signals which are in phase with each other. In practice, the winding direction of the first and second coils can be determined by the arrangement of the positive and negative connections. For example, providing opposite electrical connections on the first and second coils has the effect of reversing the winding direction of the coils.

The first electrical drive signal and/or the second electrical drive signal could be modified to have constant polarity (either positive or negative). For example, the first electrical drive signal and/or the second electrical drive signal could be generated by half-wave rectification of the source sound signal (i.e. a half-wave rectified drive signal). Alternatively, the first electrical drive signal and/or the second electrical drive signal can be generated by full-wave rectification of the source sound signal (i.e. a full-wave rectified drive signal). By combining a rectified drive signal (either full or half-wave rectified) with an alternating drive signal, the first and second diaphragms can be driven in both directions (i.e. towards and away from each other). The power source driver can comprise a half-wave or a full-wave rectifier configured to rectify the source sound signal.

In a further alternative, the power source driver could apply a DC bias signal to the first electrical drive signal and/or the second electrical drive signal. The resulting first and second electrical drive signals can be either positive or negative (rather than a combination of positive and negative components).

The speaker device can comprise an enclosure having opposing first and second sidewalls. The first and second diaphragms can be mounted to said respective first and second sidewalls. Optionally, the enclosure can define a sealed reservoir having an operating pressure above atmospheric pressure. This pressurised arrangement can help to prevent the first and second diaphragms coming into contact with each other.

A silencer can be disposed around said first and second diaphragms. The silencer can have an annular profile. The silencer can be formed from a porous material or structure. For example, the silencer could comprise a mesh or honeycomb structure.

The first magnet can be fixedly mounted to a central region of the first diaphragm. The second magnet can be fixedly mounted to a central region of said second diaphragm. The first and second magnets can be arranged co-axially, for example along a central axis of said first and second diaphragms.

A third magnet can be mounted to said first diaphragm and a fourth magnet can be mounted to said second diaphragm. The third and fourth magnets can be permanent magnets. The third and fourth magnets can be arranged to generate opposing magnetic fields to inhibit movement of the first and second diaphragms towards each other. This arrangement can help to prevent the first and second diaphragms coming into contact with each other.

According to a still further aspect of the present invention there is provided a speaker assembly comprising a plurality of speaker devices as described herein. The speaker devices can be arranged in an array.

The speaker assembly can comprise an enclosure having first and second opposing sidewalls. The first diaphragm can be mounted in said first sidewall and the second diaphragm can be mounted in said second sidewall.

According to a further aspect of the present invention there is provided a speaker device comprising or consisting of:

a frame;

a diaphragm;

a first electromagnet comprising a first coil for receiving a first electrical drive signal to establish a first magnetic field; and a second electromagnet comprising a second coil for receiving a second electrical drive signal to establish a second magnetic field;

the first electromagnet being mounted to the diaphragm and the second electromagnet being mounted to the frame;

wherein, in use, the first and second magnetic fields interact with each other to drive said first diaphragm. The speaker device can comprise a power source driver for supplying said first electrical drive signal and/or said second electrical drive signal. A plurality of the speaker devices could be arranged in an array. The frame could form part of an enclosure. For example, the second electromagnet could be mounted to a back face of the enclosure.

According to a further aspect of the present invention there is provided a speaker device comprising or consisting of:

a first diaphragm and a second diaphragm;

a first electromagnet, mounted to the first diaphragm, for generating a first magnetic field; and a second electromagnet, mounted to the second diaphragm, for generating a second magnetic field;

wherein the first and second electromagnets are disposed within the speaker device such that, when energized, the first and second electromagnet fields interact with each other to drive the first and second diaphragms. By controlling the current supplied to the first and second electromagnets, vibrations can be induced in the diaphragms to output acoustic waves. The first and second electromagnets can be configured to drive the first and second diaphragms towards each other or away from each other.

The speaker device can comprise a power source driver for generating said first electrical drive signal and/or said second electrical drive signal. The first electrical drive signal and/or the second electrical drive signal can simultaneously drive said first and second diaphragms towards each other or away from each other. The first and second electromagnets can be configured to generate opposing forces (i.e. to establish like magnetic poles disposed adjacent to each other); or to generate attractive forces (i.e. to establish opposite magnetic poles disposed adjacent to each other).

The first electromagnet can comprise a first coil and the second electromagnet can comprise a second coil. The first and second electrical drive signals can be supplied to the respective first and second coils. The first and second electrical drive signals can be in phase or out of phase (for example a differential pair) depending on the relative winding directions of the first and second coils. The winding direction of the first coil can be the same as the winding direction of the second coil when the power source driver is configured to supply first and second electrical drive signals which are out of phase with each other. Alternatively, the winding direction of the first coil can be the opposite (reverse) of the winding direction of the second coil when the power source driver is configured to supply first and second electrical drive signals which are in phase with each other.

According to an aspect of the invention there is provided a silencer suitable for use with a speaker, the silencer comprising an annular body comprising a porous material having a plurality of radially extending apertures, wherein the radially extending apertures are arranged to permit air movement as generated by the speaker through the annular body. The porous material may comprise a honeycomb structure.

Aspects of the present invention also relate to a vehicle or a vehicle door comprising a speaker device as described herein.

Within the scope of this application it is expressly intended that the various aspects, embodiments, examples and alternatives set out in the preceding paragraphs, in the claims and/or in the following description and drawings, and in particular the individual features thereof, may be taken independently or in any combination. Features described in connection with one embodiment are applicable to all embodiments, unless such features are incompatible.

BRIEF DESCRIPTION OF THE DRAWINGS

Embodiments of the present invention will now be described, by way of example only, with reference to the accompanying Figures, in which.

DETAILED DESCRIPTION OF AN EMBODIMENT

A speaker device 1 in accordance with a first embodiment of the present invention will now be described with reference to FIGS. 1 to 6. The speaker device 1 provides a directional output and has particular application in relation to motor vehicles.

Figure 2:
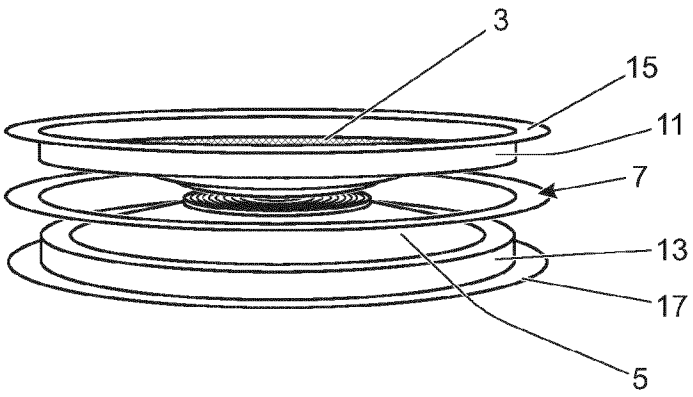
FIG. 2 shows a second perspective view of the speaker device according to the first embodiment.
Figure 1:
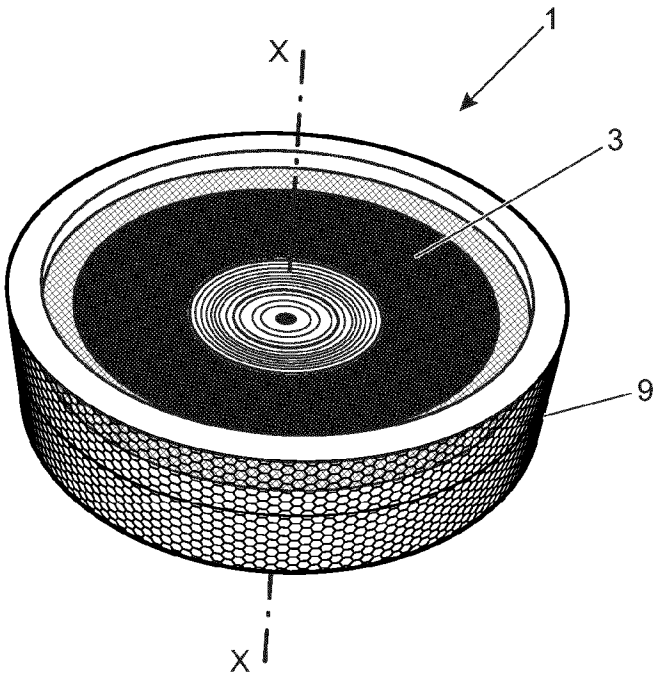
FIG. 1 shows a first perspective view of a speaker device in accordance with a first embodiment of the present invention.
Figure 3:
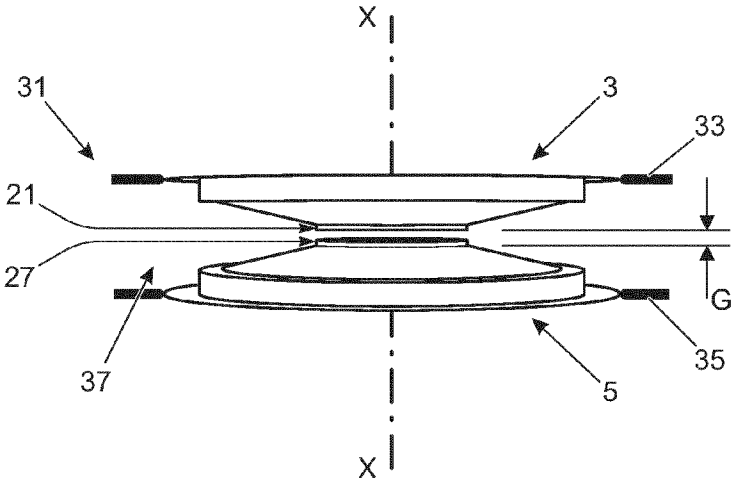
FIG. 3 shows a side elevation of the speaker device according to the first embodiment.

As shown in FIGS. 1 and 2, the speaker device 1 comprises a first diaphragm 3, a second diaphragm 5, a support frame 7 and a silencer 9. The first and second diaphragms 3, 5 are each formed from a resilient membrane having a generally frustoconical configuration which forms a sound producing surface. The first and second diaphragms 3, 5 are fixedly mounted within said support frame 7 and arranged coaxially along a central axis X. As shown in FIGS. 2 and 3, the first and second diaphragms 3, 5 are oriented to face in opposite directions, each diaphragm 3, 5 tapering outwardly along said central axis X. The diameter of the first and second diaphragms 3, 5 can be in the range of 10 cm (4") to 60 cm (24").

The support frame 7 comprises first and second annular members 11, 13 for supporting the first and second diaphragms 3, 5. Specifically, the first and second diaphragms 3, 5 comprise respective first and second circumferential flanges 15, 17 which are bonded to the first and second annular members 11, 13. The support frame 7 thereby supports the first and second diaphragms 3, 5 about their radially outer edges. The annular members 11, 13 are formed from a rigid material for providing a fixed support.

The silencer 9 is adapted to reduce or inhibit interference between vibrations generated at the front and back faces of the first and second diaphragms 3, 5 (which are out of phase with each other). The silencer 9 has an annular configuration and is disposed radially outwardly of the first and second annular members 11, 13. The silencer 9 locates between the first and second control circumferential flanges 15, 17 of the first and second diaphragms 3, 5. The silencer 9 comprises a plurality of apertures to permit the movement of air within the speaker device 1. In the present embodiment, the silencer 9 comprises a honeycomb structure having radially extending apertures.

A first electromagnet 19 is fixedly mounted to a first central region 21 of the first diaphragm 3. The first electromagnet 19 comprises a first coil 23 which forms a first voice coil of the speaker device 1. A second electromagnet 25 is fixedly mounted to a second central region 27 of the second diaphragm 5. The second electromagnet 25 comprises a second coil 29 which forms a second voice coil of the speaker device 1. The first and second coils 23, 29 are high density tape coils comprising a flat tape wound in a spiral configuration. The first and second central regions 21, 27 are spaced apart from each other along the central axis X to define an air gap G, as shown in FIG. 3. The size of the air gap G can be varied depending on the strength of the magnetic fields generated by the first and second electromagnets 19, 25. The gap G could be as small as 2 mm, 3 mm or 5 mm; or up to 60 mm or 80 mm or 100 mm. In the present embodiment, the gap G is approximately 25 mm. A flexible suspension could optionally be provided to support the first and second electromagnets 19, 25.

Figure 4:
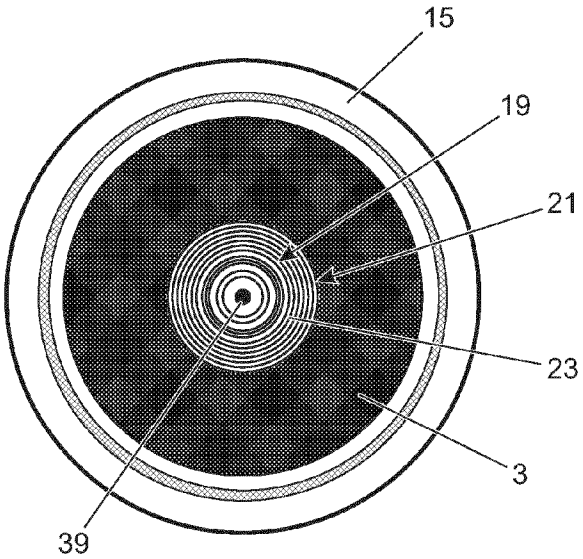
FIG. 4 shows a plan view of the speaker device according to the first embodiment.
Figure 5:
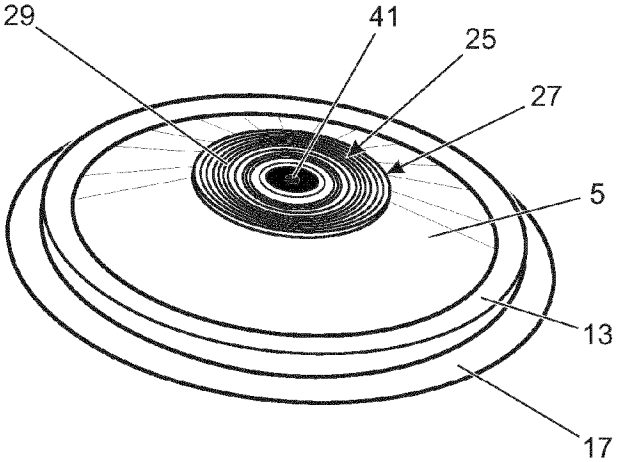
FIG. 5 shows a perspective view of a diaphragm of the speaker device.

As shown in FIGS. 4 and 5, the first and second central regions 21, 27 each comprise a substantially planar disc extending radially in relation to the central axis X. This planar arrangement reduces the size of the air gap G between the first and second central regions 21, 27, thereby positioning the first and second electromagnets 19, 25 proximal to each other.

A power source driver (not shown) is provided to supply first and second electrical drive signals to the respective first and second coils 23, 29 of the electromagnets 19, 25. The first and second electrical drive signals are variable signals generated by the power source driver in dependence on a source sound signal. The electrical drive signals cause the first and second coils 23, 29 to generate respective first and second electromagnetic fields. The proximal location of the first and second electromagnets 19, 25 promotes the interaction of each coil 23, 29 with the magnetic field generated by the other coil 23, 29. This mutual interaction between the first and second coils 23, 29 drives the first and second diaphragms 3, 5 causing them to be displaced in opposite directions. The first and second diaphragms 3, 5 can thereby be controlled in dependence on the first and second electrical drive signals supplied by the power source driver. The resilience of the first and second diaphragms 3, 5 biases the first and second electromagnets 19, 25 to their original positions. Alternatively, or in addition, a resilient suspension member could be associated with each diaphragm, for example to couple the coil 23, 29 to the support frame 7.

The speaker device 1 is configured to displace the coils 23, 29 simultaneously such that the first and second diaphragms 3, 5 generate in-phase acoustic vibrations. In the present embodiment, the coils 23, 29 and the power source drive are configured to generate opposing magnetic fields (i.e. like poles of the first and second electromagnets 19, 25 being positioned adjacent to each other) which apply a force to drive the first and second diaphragms 3, 5 outwardly along the central axis X (i.e. an excursion) when the coils 23, 29 are energized. The winding direction of the first coil 23 can be the same as the winding direction of the second coil 29 and the first and second electrical drive signals can be out of phase with each other. In an alternate arrangement, the winding direction of the first coil 23 can be the opposite of that of the second coil 29 and the first and second electrical drive signals can be in phase with each other. In practice, the winding direction of the first and second coils 23, 29 can be determined by their respective electrical connections. For example, the first and second coils 23, 29 can have the same winding direction by providing the same electrical connections; or can have opposite winding directions by reversing their electrical connections.

In an alternative configuration, the coils 23, 29 and the power source driver could be configured to generate attractive magnetic fields (i.e. opposite poles of the first and second electromagnets 19, 27 being positioned adjacent to each other) which apply a force to drive the first and second diaphragms 3, 5 towards each other (i.e. a depression) when the coils 23, 29 are energized. The winding direction of the first coil 23 can be the same as the winding direction of the second coil 29 and the first and second electrical drive signals can be in phase with each other. In an alternate arrangement, the winding direction of the first coil 23 can be the opposite of that of the second coil 29 and the first and second electrical drive signals can be out of phase with each other. The first and second electrical drive signals could be configured to drive the diaphragms 3, 5 both towards and away from each other. For example, the electrical signal supplied to either the first coil 23 or the second coil 29 could be rectified.

The first and second diaphragms 3, 5 are mounted in an enclosure 31. The enclosure 31 comprises a front face 33 to which the first diaphragm 3 is mounted; and a rear face 35 to which the second diaphragm 5 is mounted. The enclosure 31 forms a reservoir 37 to suppress unwanted noise generated by the first and second diaphragms 3, 5. The reservoir 37 can be sealed and slightly pressurised (i.e. the operating pressure is above atmospheric pressure) to reduce the likelihood of the first and second diaphragms 3, 5 coming into contact with each other. In the present embodiment, the reservoir 37 is toroidal in shape and extends around the circumference of the diaphragms 3, 5. The reservoir 37 remains in communication with the region disposed between the diaphragms 3, 5. In an alternate configuration, the first and second diaphragms 3, 5 can have an open configuration and the reservoir 37 omitted.

In use, the power source driver outputs first and second electrical drive signals to the respective first and second coils 23, 29 in dependence on a sound signal. When energized, the first coil 23 generates a first magnetic field which interacts with the second coil 29. When energized, the second coil 29 generates a second magnetic field which interacts with the first coil 23. In the present embodiment, the resultant forces applied to the first and second coils 23, 29 displace them axially outwardly such that the first and second central regions 21, 27 are moved apart. The first and second diaphragms 3, 5 are thereby driven by the first and second coils 23, 29. The first and second electrical drive signals are controlled in dependence on the source sound signal to induce vibrations which generate acoustic sound waves based on the sound signal.

A DC bias signal can optionally be applied to the source sound signal to generate the first and second electrical drive signals. The resulting first and second electrical drive signals can be either positive or negative (rather than a combination of positive and negative components). The relative position of the first and second diaphragms 3, 5 corresponds to the differential between the first and second magnetic fields generated by the first and second coils 23, 29. The speaker device 1 thereby forms a differential transducer. The diaphragms 3, 5 are each formed from a resilient material which biases the first and second coils 23, 29 towards a neutral position. When the differential between the first and second electrical drive signals decreases, the resilience of the material biases the diaphragms 3, 5 towards their respective neutral positions. The size of the air gap G can optionally be controlled by the application of the DC bias signal to the first electrical drive signal and/or the second electrical drive signal. The DC bias signal could, for example, be applied to bias the diaphragms 3, 5 towards or away from each other to adjust the gap G.

The first and second diaphragms 3, 5 in the present embodiment have the same configuration. Accordingly, the sound waves operatively generated by the diaphragms 3, 5 when the coils 23, 29 are energized would be substantially the same. The first and second diaphragms 3, 5 could have different configurations in order to output asymmetric sound waves. For example, the profile and/or structure and/or material of the diaphragms 3, 5 could be different to provide different acoustic properties. In an asymmetric arrangement, the first diaphragm 3 could be configured as a front diaphragm 3; and the second diaphragm 5 could be configured as a rear diaphragm 5. In use, the front diaphragm 3 could be oriented to direct the acoustic waves towards a user, for example mounted to a vehicle door and facing inwardly into the vehicle; and the rear diaphragm 5 could be oriented away from the user, for example mounted to the vehicle door and facing outwardly.

The first and second diaphragms 3, 5 could potentially contact each other across the air gap G and this may generate an unwanted sound in the speaker device 1 and could potentially damage the coils 23, 29. To help prevent contact when operational, first and second permanent magnets 39, 41 can be mounted to the first and second central regions 21, 27. The first and second permanent magnets 39, 41 are arranged to position like poles adjacent to each other. The resultant opposing magnetic forces can help to prevent the first and second central regions 21, 27 coming into contact with each other. The size and strength of the first and second permanent magnets 39, 41 can be selected such that the opposing magnetic forces only affect the movement of the first and second diaphragms 3, 5 when the air gap G is very small. The first and second permanent magnets 39, 41 can be formed from paramagnetic, diamagnetic or ferromagnetic materials.

Figure 6A:
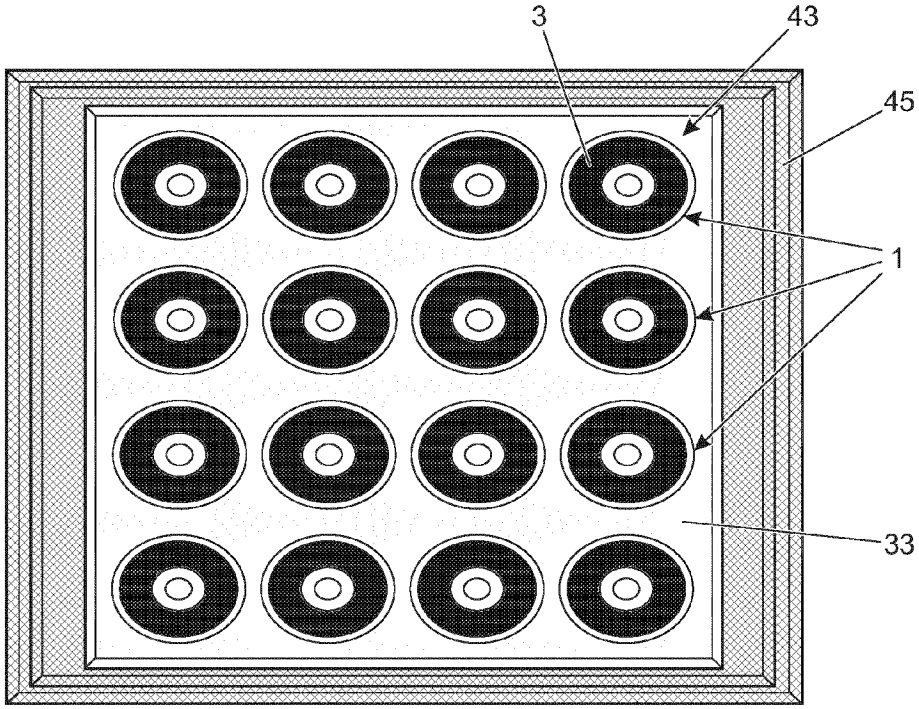
FIGS. 6A and 6B show respective plan and side elevations of a speaker assembly incorporating a plurality of the speaker devices according to the first embodiment.
Figure 6B:
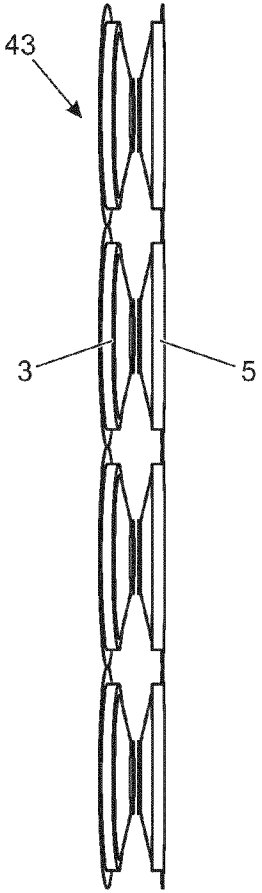

The speaker device 1 can form a mono speaker or could be coupled with one or more like speaker devices 1, for example to provide two (i.e. stereo) or more sound outputs (for example a surround sound system). Furthermore, a plurality of the speaker devices 1 can be arranged in an array 43 to form a speaker panel 45, as shown in FIGS. 6A and 6B. In the illustrated arrangement, the array comprises sixteen (16) of said speaker devices 1 arranged in a 4×4 matrix within the enclosure 31. The first diaphragm 3 of each speaker device 1 is mounted to the front face 33 of the enclosure 31; and the second diaphragm 5 of each speaker device 1 is mounted to the rear face 35 of the enclosure 31.

As shown in FIG. 6B, the reservoir 37 is common to all of the speaker devices 1 within the array 43.

The speaker device 1 is suitable for use in a motor vehicle. The front face 33 of the enclosure 31 could be arranged such that the first diaphragm 3 faces inwardly into a vehicle cabin. For example, the front face 33 could be mounted to a door trim panel or a parcel shelf within the vehicle. Other applications for the speaker device 1 are also contemplated.

Figure 7:
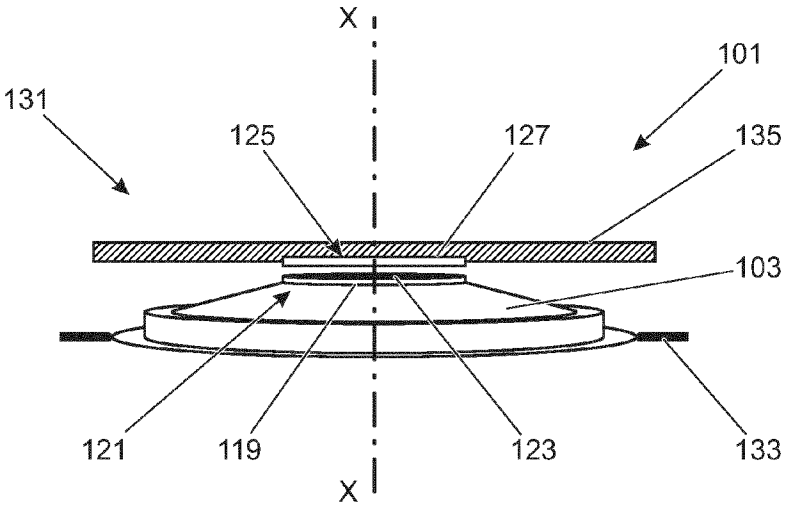
FIG. 7 shows a side elevation of a speaker device according to a second embodiment of the present invention.

A speaker device 101 according to a second embodiment of the present invention is illustrated in FIG. 7. Like reference numerals are used for like components, albeit incremented by 100 for clarity.

The speaker device 101 comprises a first diaphragm 103 mounted to a front face 133 of an enclosure 131. The first diaphragm 103 is generally unchanged from the first embodiment and comprises a membrane having a frustoconical configuration. A first electromagnet 119 is fixedly mounted to a first central region 121 of the first diaphragm 103. The first electromagnet 119 comprises a first coil 123 which forms a first voice coil of the speaker device 101.

The second diaphragm 5 is omitted from this embodiment. Rather, a second electromagnet 125 is fixedly mounted to a back face 135 of the enclosure 131. The second electromagnet 125 comprises a second coil 129 which forms a second voice coil of the speaker device 101. The first and second electromagnets 119, 125 are mounted along the central axis X which is arranged co-axially with a longitudinal axis of the first diaphragm 103.

The first diaphragm 103 is disposed within the enclosure 131 to form an air gap G between the first and second electromagnets 119, 125. A power source driver is provided for supplying respective first and second electrical drive signals to the first and second coils 123, 129. The first and second electrical drive signals induce first and second magnetic fields in the first and second coils 123, 129. The mutual interaction between the first and second coils 123, 129 drives the first diaphragm 103. The first and second electrical drive signals thereby drive the first diaphragm 103 causing it to vibrate and create sound.

It will be appreciated that various changes and modifications can be made to the speaker device 1 described herein. For example, the embodiment of the speaker device 1 described herein comprises first and second like diaphragms 3, 5. However, the first and second diaphragms 3, 5 could have different profiles, for example defined by different taper angles in the frustoconical section.

A further modification would be to rely on mutual electromagnetic induction between the first and second coils 23, 29; 123; 129. A first electrical drive signal can be supplied to the first coil 23; 123 and the second coil 29; 129 can be arranged as a closed (short) circuit. The resulting mutual electromagnetic induction can induce an opposing magnetic field in the second coil 29; 129. The opposing magnetic field could apply a driving force to drive the first and second diaphragms 3, 5 away from each other; or to drive the first diaphragm 103 away from the back face 135 of the enclosure 131.

The invention claimed is:

1. A speaker device comprising:

a first diaphragm and a second diaphragm;

a first magnet, mounted to the first diaphragm, for generating a first magnetic field;

a second magnet, mounted to the second diaphragm, for generating a second magnetic field; and a silencer disposed around said first and second diaphragms and comprising a porous material;

wherein the first magnet is a first electromagnet comprising a first coil for receiving a first electrical drive signal to establish said first magnetic field;

the first and second magnets being positioned such that, in use, said first and second magnetic fields interact with each other to drive said first and second diaphragms; and wherein the first magnet and second magnet are spaced apart by a gap with no intervening magnet within the gap.

2. A speaker device as claimed in claim 1, wherein the second magnet is a second electromagnet comprising a second coil for receiving a second electrical drive signal to establish said second magnetic field.

3. A speaker device as claimed in claim 1 comprising a power source driver configured operatively to supply said first electrical drive signal and/or said second electrical drive signal to drive said first and second diaphragms in opposite directions.

4. A speaker device as claimed in claim 3, wherein the power source driver is configured operatively to control said first electrical drive signal and/or said second electrical drive signal to drive said first and second diaphragms towards each other and/or to drive said first and second diaphragms away from each other.

5. A speaker device as claimed in claim 3, wherein the winding direction of the first coil is the same as the winding direction of the second coil and the power source driver is configured to supply first and second electrical drive signals which are out of phase with each other; or the winding direction of the first coil is the opposite of the winding direction of the second coil and the power source driver is configured to supply first and second electrical drive signals which are in phase with each other.

6. A speaker device as claimed in claim 1, wherein the second magnet is a permanent magnet.

7. A speaker device as claimed in claim 1, wherein the first and second diaphragms communicate with a sealed reservoir.

8. A speaker device as claimed in claim 7, wherein the sealed reservoir has an operating pressure above atmospheric pressure.

9. A speaker device as claimed in claim 1, wherein said first diaphragm comprises a first cone and the first magnet is mounted to a central region of said first cone; and said second diaphragm comprises a second cone and the second magnet is mounted to a central region of said second cone.

10. A speaker assembly comprising a plurality of the speaker devices claimed in claim 1.

11. A speaker assembly as claimed in claim 10 comprising an enclosure having a first sidewall and a second sidewall, the first sidewall and the second sidewall opposing each other, wherein the first diaphragms are disposed in said first sidewall and the second diaphragms are disposed in said second sidewall.

12. A vehicle comprising a speaker device as claimed in claim 1.

13. A vehicle comprising a speaker assembly as claimed in claim 10.

14. A speaker device as claimed in claim 1, wherein the gap is an air gap.

15. A speaker device comprising:

a first diaphragm and a second diaphragm;

a first magnet, mounted to the first diaphragm, for generating a first magnetic field;

a second magnet, mounted to the second diaphragm, for generating a second magnetic field;

a third magnet mounted to said first diaphragm and a fourth magnet mounted to said second diaphragm, the third and fourth magnets having opposing magnetic fields to inhibit movement of the first and second diaphragms towards each other; and a silencer disposed around said first and second diaphragms and comprising a porous material;

wherein the first magnet is a first electromagnet comprising a first coil for receiving a first electrical drive signal to establish said first magnetic field;

the first and second magnets being positioned such that, in use, said first and second magnetic fields interact with each other to drive said first and second diaphragms.

16. A silencer suitable for use with a speaker device comprising a first diaphragm, a second diaphragm, a first magnet mounted to the first diaphragm, a second magnet mounted to the second diaphragm, wherein the first diaphragm and second diaphragm are spaced apart by a gap with no intervening magnet within the gap, the silencer configured to be disposed around said first and second diaphragms of the speaker device, the silencer comprising an annular body comprising a porous material having a plurality of radially extending apertures, wherein the silencer is arranged to inhibit interference between vibrations generated, in use, at said first diaphragm of said speaker device and vibrations generated, in use, at said second diaphragm of said speaker device;

wherein the radially extending apertures are arranged to permit air movement as generated by said speaker device through the annular body.

17. A silencer as claimed in claim 16 wherein the porous material comprises a honeycomb structure.

18. A motor vehicle comprising a speaker device and a silencer for use with the speaker device as claimed in claim 16.

19. A silencer as claimed in claim 16, wherein the silencer is arranged to extend between said first diaphragm and said second diaphragm of said speaker device.

20. A silencer as claimed in claim 16, wherein the gap is an air gap.

* * * * *